US011308896B2

(12) United States Patent
Shi et al.

(10) Patent No.: US 11,308,896 B2
(45) Date of Patent: Apr. 19, 2022

(54) LIQUID CRYSTAL DISPLAY DEVICE AND CONTROL METHOD THEREOF, HEAD-MOUNTED DISPLAY APPARATUS AND MEDIUM

(71) Applicants: BOE MLED TECHNOLOGY CO., LTD., Beijing (CN); BOE TECHNOLOGY GROUP CO., LTD., Beijing (CN)

(72) Inventors: Tiankuo Shi, Beijing (CN); Zhihua Ji, Beijing (CN); Xiaomang Zhang, Beijing (CN); Lingyun Shi, Beijing (CN); Xiurong Wang, Beijing (CN); Hao Zhang, Beijing (CN); Lili Chen, Beijing (CN); Yilang Sun, Beijing (CN); Yifang Chu, Beijing (CN); Yanhui Xi, Beijing (CN); Wenyu Li, Beijing (CN); Ming Chen, Beijing (CN)

(73) Assignees: BOE MLED TECHNOLOGY CO., LTD., Beijing (CN); BOE TECHNOLOGY GROUP CO., LTD, Beijing (CN)

( * ) Notice: Subject to any disclaimer, the term of this patent is extended or adjusted under 35 U.S.C. 154(b) by 188 days.

(21) Appl. No.: 16/611,800

(22) PCT Filed: Feb. 22, 2019

(86) PCT No.: PCT/CN2019/075779
§ 371 (c)(1),
(2) Date: Nov. 7, 2019

(87) PCT Pub. No.: WO2019/218742
PCT Pub. Date: Nov. 21, 2019

(65) Prior Publication Data

US 2021/0335290 A1 Oct. 28, 2021

(30) Foreign Application Priority Data

May 17, 2018 (CN) ..... 201810476300.5

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2320/0247* (2013.01); *G09G 2320/062* (2013.01); *G09G 2320/0686* (2013.01)

(58) Field of Classification Search
CPC ..... G09G 3/3426
See application file for complete search history.

(56) References Cited

U.S. PATENT DOCUMENTS

2012/0007896 A1 1/2012 Kwon et al.
2012/0218301 A1* 8/2012 Miller ..... G02B 27/0172 345/633

(Continued)

FOREIGN PATENT DOCUMENTS

CN 102314844 A 1/2012
CN 105161064 A 12/2015

(Continued)

OTHER PUBLICATIONS

International Search Report received for PCT Patent Application No. PCT/CN2019/075779, dated May 7, 2019, 6 pages (2 pages of English Translation and 4 pages of Original Document).

(Continued)

*Primary Examiner* — Gustavo Polo
(74) *Attorney, Agent, or Firm* — Womble Bond Dickinson (US) LLP

(57) ABSTRACT

The embodiments of this disclosure disclose a liquid crystal display device and a control method thereof, a head-mounted display device and a computer-readable storage medium. The control method of the liquid crystal display device comprises: obtaining a state of each pixel in the display panel based on inputted image data; obtaining a display zone comprising both pixels in a bright state and pixels in a dark state based on the state of each pixel in the display panel, and using the obtained display zone as a destination zone; obtaining a halo region based on the state of the pixels in the destination zone, wherein the halo region (Continued)

comprises pixels in the dark state in the destination zone; generating a first control signal based on the halo region; and controlling based on the first control signal a backlight zone to be adjusted.

16 Claims, 6 Drawing Sheets

(56) References Cited

U.S. PATENT DOCUMENTS

| | | | |
|---|---|---|---|
| 2016/0379575 | A1 | 12/2016 | Kawai et al. |
| 2017/0084232 | A1 | 3/2017 | Yang et al. |
| 2018/0090077 | A1 | 3/2018 | Zou et al. |

FOREIGN PATENT DOCUMENTS

| | | | |
|---|---|---|---|
| CN | 105575341 | A | 5/2016 |
| CN | 106328071 | A | 1/2017 |
| CN | 108470548 | A | 8/2018 |

OTHER PUBLICATIONS

Office Action received for Chinese Patent Application No. 201810476300.5, dated Jul. 8, 2019, 9 pages (4 pages of English Translation and 5 pages of Office Action).

* cited by examiner

LIQUID CRYSTAL DISPLAY DEVICE AND CONTROL METHOD THEREOF, HEAD-MOUNTED DISPLAY APPARATUS AND MEDIUM

CROSS REFERENCE TO RELATED APPLICATIONS

The present application is a 35 U.S.C. 371 national stage application of PCT International Application No. PCT/CN2019/075779, filed on Feb. 22. 2019, which claims the benefit of Chinese Patent Application No. 201810476300.5, filed on May 17 2018, the entire disclosures of which are incorporated herein by reference.

TECHNICAL FIELD

Embodiments of this disclosure relate to the field of display technologies, and specifically relate to a liquid crystal display device and a control method thereof, a head-mounted display device and a computer-readable storage medium.

BACKGROUND

Liquid crystal display (LCD) devices have advantages such as low radiation, small size and low energy consumption and hence are widely applied in electronic products such as tablet computers, televisions or cellphones. An existing liquid crystal display (LCD) device uses an array of micro light emitting diodes (Micro LEDs) as a backlight. When the light emitting diodes are micro light emitting diodes (Micro LEDs), the liquid crystal display (LCD) device has a bigger dynamic range and more optimized power consumption.

SUMMARY

According to an aspect of this disclosure, a method for controlling a liquid crystal display device is provided. The liquid crystal display device comprises a display panel and a backlight device. The backlight device comprises at least one backlight zone. The display panel comprises at least one display zone. The backlight zone and the display zone correspond to each other. The method may comprise: obtaining a state of each pixel in the display panel based on inputted image data, the state of the pixel comprising a bright state or a dark state; obtaining a display zone comprising both pixels in the bright state and pixels in the dark state based on the state of each pixel in the display panel, and using the obtained display zone as a destination zone; obtaining a halo region based on the state of the pixels in the destination zone, wherein the halo region is a region comprising pixels in the dark state in the destination zone; generating a first control signal based on the halo region; and controlling based on the first control signal a backlight zone to be adjusted, wherein the backlight zone adjacent to a destination backlight zone is determined as the backlight zone to be adjusted, and the destination backlight zone and the destination zone correspond to each other.

In one embodiment, the method may further comprise: obtaining based on the state of each pixel in the display panel a display zone in which the pixels are all in the dark state; determining whether a display zone adjacent to the display zone comprises the destination zone; if the display zone adjacent to the display zone comprises the destination zone, determining that a backlight zone corresponding to the display zone in which the pixels are all in the dark state is the backlight zone to be adjusted; If the display zone adjacent to the display zone does not comprise the destination zone, determining that a backlight zone corresponding to the display zone in which the pixels are all in the dark state is not the backlight zone to be adjusted.

In one embodiment, the method may further comprise: obtaining based on the state of each pixel in the display panel a display zone in which the pixels are all in the bright state; and determining that a backlight zone corresponding to the display zone is not the backlight zone to be adjusted.

In one embodiment, the method may further comprise: generating a second control signal based on the halo region; and controlling based on the second control signal a display zone corresponding to the backlight zone to be adjusted.

In one embodiment, controlling based on the second control signal a display zone corresponding to the backlight zone to be adjusted may comprise controlling the pixels in the display zone corresponding to the backlight zone to be adjusted to be switched on or off.

In one embodiment, controlling the pixels in the display zone corresponding to the backlight zone to be adjusted to be switched on or off may comprise: switching on more pixels in the display zone close to the destination zone; and switching off more pixels in the display zone remote from the destination zone.

In one embodiment, obtaining a state of each pixel in the display panel based on inputted image data may comprise: obtaining a brightness value of each pixel in the display panel based on inputted image data; determining a state of each pixel based on the brightness value of each pixel and a threshold brightness, and determining that the pixel is in the bright state when the brightness value of the pixel is greater than or equal to the threshold brightness; and determining that the pixel is in the dark state when the brightness value of the pixel is smaller than the threshold brightness.

In one embodiment, generating a first control signal based on the halo region comprises determining whether an area of the halo region is equal to a threshold area, and generating a first control signal when the area of the halo region is not equal to the threshold area.

In one embodiment, prior to obtaining a state of each pixel in the display panel based on inputted image data, the method may further comprise obtaining and storing inputted image data.

According to another aspect of this disclosure, a liquid crystal display device is provided. The liquid crystal display device may comprise: a display panel comprising at least one display zone; a backlight device comprising at least one backlight zone, wherein the backlight zone and the display zone correspond to each other; a processing circuit configured to obtain a state of each pixel in the display panel based on inputted image data, the state of the pixel comprising a bright state or a dark state, obtaining a display zone comprising both pixels in the bright state and pixels in the dark state based on the state of each pixel in the display panel, using the obtained display zone as a destination zone, obtaining a halo region based on the state of the pixels in the destination zone, and generating a first control signal based on the halo region, wherein the halo region comprises pixels in the dark state in the destination zone; and a first driving circuit connected with the processing circuit and the backlight device and configured to control based on the first control signal a backlight zone to be adjusted, wherein the backlight zone adjacent to a destination backlight zone is determined as the backlight zone to be adjusted, and the destination backlight zone and the destination zone correspond to each other.

In one embodiment, the processing circuit may be further configured to: obtain based on the state of each pixel in the display panel a display zone in which the pixels are all in the dark state; determining whether a display zone adjacent to the display zone comprises the destination zone; if the display zone adjacent to the display zone comprises the destination zone, determining that a backlight zone corresponding to the display zone in which the pixels are all in the dark state is the backlight zone to be adjusted; if the display zone adjacent to the display zone does not comprise the destination zone, determining that a backlight zone corresponding to the display zone in which the pixels are all in the dark state is not the backlight zone to be adjusted.

In one embodiment, the processing circuit may be further configured to: obtain based on the state of each pixel in the display panel a display zone in which the pixels are all in the bright state; and determining that a backlight zone corresponding to the display zone is not the backlight zone to be adjusted.

In one embodiment, the processing circuit may be further configured to: generate a second control signal based on the halo region. The device may further comprise a second driving circuit connected with the processing circuit and the display panel and configured to control based on the second control signal a display zone corresponding to the backlight zone to be adjusted.

In one embodiment, the processing circuit may be further configured to: obtain a brightness value of each pixel in the display panel based on inputted image data; and determine a state of each pixel based on the brightness value of each pixel and a threshold brightness, and determine that the pixel is in the bright state when the brightness value of the pixel is greater than or equal to the threshold brightness; and determine that the pixel is in the dark state when the brightness value of the pixel is smaller than the threshold brightness.

In one embodiment, the processing circuit may be further configured to: obtain the halo region based on the pixels in the dark state in the destination zone; and determine whether an area of the halo region is equal to a threshold area, and generate the first control signal when the area of the halo region is not equal to the threshold area.

In one embodiment, the device may further comprise: an obtaining circuit connected with the processing circuit and configured to obtain inputted image data; and a storage circuit connected with the obtaining circuit and configured to store the obtained inputted image data.

According to yet another aspect of this disclosure, a head-mounted display device is provided. The head-mounted display device may comprise the liquid crystal display device as mentioned above.

According to still another aspect of this disclosure, a computer-readable storage medium is provided. The computer-readable storage medium stores a computer program capable of running on a processor. When running on the processor, the computer program executes steps of the method for controlling the liquid crystal display device as mentioned above.

Other features and advantages of this disclosure will be detailed subsequently in the description, and will partly become obvious from the description, or be understood by carrying out this disclosure. Objects and other advantages of this disclosure can be realized and achieved from structures specifically pointed out in the description, the claims and the drawings.

BRIEF DESCRIPTION OF DRAWINGS

The drawings are used to provide further understanding of the technical solutions of this disclosure and constitute part of the description. They are used together with embodiments of this disclosure to explain the technical solutions of this disclosure instead of limiting them.

DETAILED DESCRIPTION OF EMBODIMENTS

To render the objects, the technical solutions and the advantages of this disclosure clearer, the embodiments of this disclosure will be described below in detail with reference to the drawings. It should be noted that the embodiments of the present application and the features of the embodiments can be combined with each other randomly under the circumstances that there is no conflict.

The steps shown in the flow chart of the drawings may be executed in a computer system of a group of computer-executable instructions for example. Moreover, although a logical sequence is shown in the flow chart, the steps shown or described may be executed in a different sequence in some circumstances.

Unless otherwise defined, technical terms or scientific terms used in the embodiments of this disclosure should have common meanings understood by one having ordinary skills in the art of this disclosure. The wordings of "first", "second" or the like used in the embodiments of this disclosure do not indicate any sequence, number or importance, but instead, they are only intended for differentiating different components. The wordings of "comprise", "include" or the like mean that elements or objects preceding the wordings encompass elements or objects listed after the wordings and equivalents thereof, and do not exclude other elements or objects. The wordings of "connect", "connection" or the like are not limited to physical or mechanical connection, but instead can comprise electrical connections either direct or indirect.

After studies, the inventor found that the backlight in a liquid crystal display device has a point diffusion effect, which will result in a halo in the display content of the virtual liquid crystal display device, and the halo will flicker with a constantly changing size as the display content moves, so a better display effect cannot be achieved.

The embodiments of this disclosure provide a liquid crystal display device and a control method thereof, a head-mounted display device and a computer-readable storage medium capable of preventing the halo from flickering with a constantly changing size as the display content moves, thereby achieving a better display effect.

Figure 1:
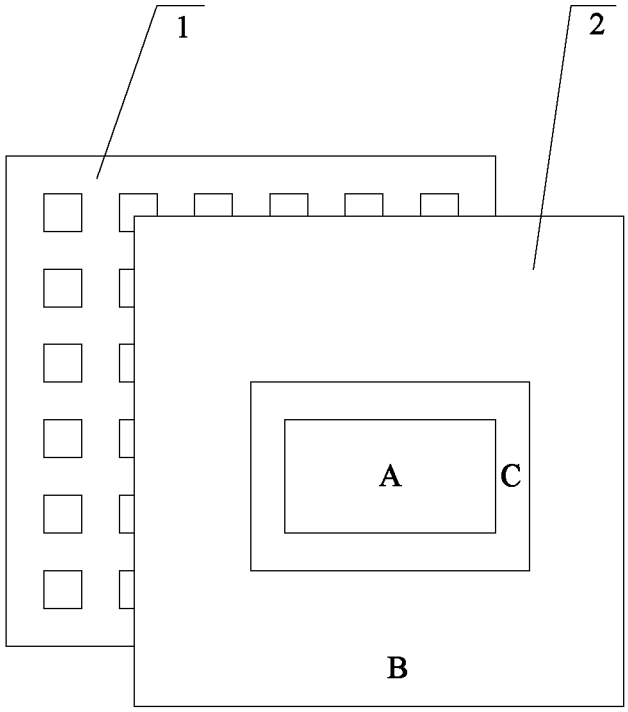
FIG. 1 is a schematic view of the display effect of a liquid crystal display device in related arts.
Figure 2:
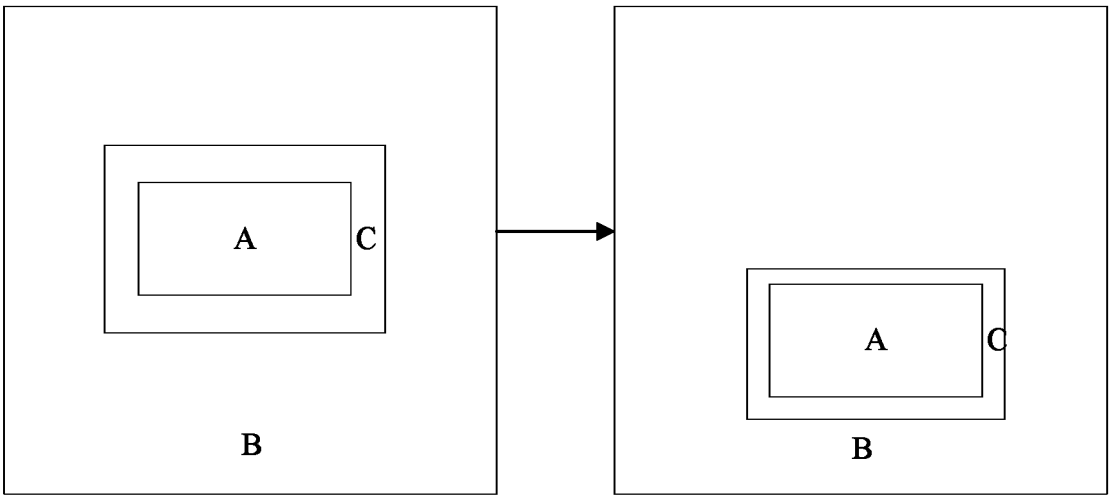
FIG. 2 is a schematic view showing halo changes before and after movement of the display content of the liquid crystal display device in related arts.

FIG. 1 is a schematic view of the display effect of a liquid crystal display device in related arts. The liquid crystal display device provided in FIG. 1 may be applied in virtual display video glasses. As shown in FIG. 1, the liquid crystal display device may comprise a backlight 1 and a display panel 2. The backlight 1 comprises light emitting diodes arranged in an array. The display panel 2 comprises an image display region A and an image-free display region B. According to the design of the liquid crystal display device, the brightness of the image-free display region B is almost zero. However, due to the point diffusion effect of the light emitting diodes arranged in an array, there will be a halo region C around the image display region A, which has a brightness far lower than that of the image display region A but higher than that of the image-free display region B, i.e., a halo is produced. The halo is especially sensitive in case of a large area black background around it. FIG. 2 is a schematic view showing halo changes before and after movement of the display content of the liquid crystal display device in related arts. As shown in FIG. 2, the area of the halo C suddenly becomes large or small as the display content moves, and as a result, the halo flickers, which influences the viewing effect a lot.

It should be noted that FIG. 2 illustrates an example in which the area of the halo decreases after the display content moves. Apparently, the area of the halo may also increase. Whether the area of the halo increases or decreases depends on the position to which the display content moves.

In order to prevent the halo from flickering with a constantly changing size and achieve a better display effect, the embodiments of this disclosure provide a liquid crystal display device and a control method thereof, a head-mounted display device and a computer-readable storage medium.

Figure 3:
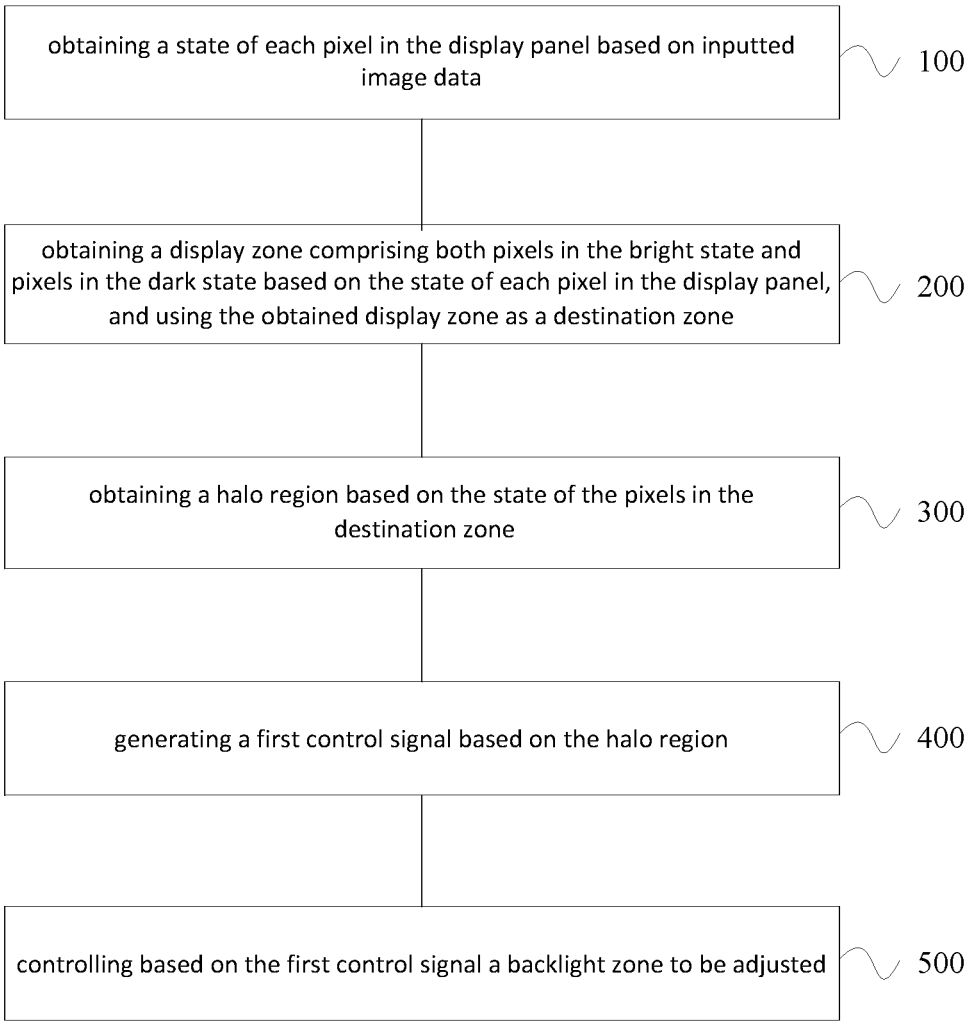
FIG. 3 is a flow chart showing a method for controlling a liquid crystal display device provided in an embodiment of this disclosure.

An embodiment of this disclosure provides a method for controlling a liquid crystal display device. The liquid crystal display device may comprise a display panel and a backlight device. The backlight device may comprise at least one backlight zone. The display panel may comprise at least one display zone. The backlight zone and the display zone correspond to each other. FIG. 3 is a flow chart showing the method for controlling the liquid crystal display device provided in an embodiment of this disclosure. As shown in FIG. 3, the method for controlling the liquid crystal display device may comprise step 100, step 200, step 300, step 400 and step 500.

At step 100, a state of each pixel in the display panel is obtained based on inputted image data.

The state of the pixel may comprise a bright state or a dark state. The inputted image data may be RGB image data.

In one embodiment, step 100 may comprise: obtaining a brightness value of each pixel in the display panel based on inputted image data; and determining a state of each pixel based on the brightness value of each pixel and a threshold brightness, and determining that the pixel is in the bright state when the brightness value of the pixel is greater than or equal to the threshold brightness; and determining that the pixel is in the dark state when the brightness value of the pixel is smaller than the threshold brightness.

It should be noted that the threshold brightness is selected based on specific situations, which will not be limited in the embodiments of this disclosure in any way.

At step 200, a display zone comprising both pixels in the bright state and pixels in the dark state is obtained based on the state of each pixel in the display panel, and the obtained display zone is used as a destination zone.

It should be noted that the halo only occurs in the destination zone. Neither a display zone comprising only pixels in the bright state nor a display zone comprising only pixels in the dark state will be used as the destination zone.

It should be noted that the number of the destination zones is not just one, and it can depend on the inputted image data. The number of the destination zones will not be specifically limited in the embodiments of this disclosure.

At step 300, a halo region is obtained based on the state of the pixels in the destination zone.

The halo region comprises pixels in the dark state in the destination zone.

At step 400, a first control signal is generated based on the halo region.

In one embodiment, step 400 may comprise: determining whether an area of the halo region is equal to a threshold area, and generating the first control signal when the area of the halo region is not equal to the threshold area.

When the area of the halo region is equal to the threshold area, it means that the backlight zone does not need to be adjusted.

According to this disclosure, the threshold area specifically depends on actual needs, and it may be an area of the halo region corresponding to the display content before movement of the display panel, or other areas as long as the area of the halo region is constant. This will not be limited in the embodiments of this disclosure in any way.

At step 500, a backlight zone to be adjusted is controlled based on the first control signal.

In one embodiment, controlling based on the first control signal a backlight zone to be adjusted may comprise controlling a degree of conductivity of the light emitting diodes (LEDs) in the backlight zone to be adjusted (e.g., through compensative conduction). In one embodiment, the display brightness of the light emitting diodes (LEDs) is controlled by adjusting a PWM signal of the light emitting diodes (LEDs) in the backlight zone.

In one embodiment, the backlight zone adjacent to a destination backlight zone is determined as the backlight zone to be adjusted, wherein the destination backlight zone and the destination zone correspond to each other. It should be noted that the backlight zone adjacent to the destination backlight zone refers to a backlight zone next to the destination backlight zone, e.g., a backlight zone above, below, on the left of, on the right of, diagonally above and diagonally below the destination backlight zone.

In one embodiment, the control method may further comprise: obtaining based on the state of each pixel in the display panel a display zone in which the pixels are all in the dark state; determining whether a display zone adjacent to the display zone comprises the destination zone; if the display zone adjacent to the display zone comprises the destination zone, determining that a backlight zone corresponding to the display zone in which the pixels are all in the dark state is the backlight zone to be adjusted; if the display zone adjacent to the display zone does not comprise the destination zone, determining that a backlight zone corresponding to the display zone in which the pixels are all in the dark state is not the backlight zone to be adjusted.

In one embodiment, the control method may further comprise: obtaining based on the state of each pixel in the display panel a display zone in which the pixels are all in the bright state; and determining that a backlight zone corresponding to the display zone is not the backlight zone to be adjusted.

In this embodiment, the backlight device is arranged on a back side of the display panel and used for transmitting via the display panel light for image display, and it comprises several light emitting elements, wherein the light emitting elements are micro light emitting diodes (Micro LEDs), and at least one micro light emitting diode (Micro LED) is arranged in an array, and each backlight zone comprises at least one micro light emitting diode (Micro LED) arranged in an array. It should be noted that the number of zones divided in the backlight device and the display panel specifically depends on the arrangement of the liquid crystal display device, which will not be limited in the embodiments of this disclosure in any way.

It should be noted that the display zone and the backlight zone corresponding to each other specifically means that in a direction perpendicular to the display panel, the projection of each display zone only covers that of the backlight zone corresponding thereto, i.e, projections of different display zones cover projections of different backlight zones.

It should be noted that the control method of the liquid crystal display device provided in an embodiment of this disclosure may be applied in a scene in which the display content of the display panel moves.

An embodiment of this disclosure provides a method for controlling a liquid crystal display device. The liquid crystal display device comprises a display panel and a backlight device. The backlight device comprises at least one backlight zone, and the display panel comprises at least one display zone. The backlight zone and the display zone correspond to each other. The method comprises: obtaining a state of each pixel in the display panel based on inputted image data, the state of the pixel comprising a bright state or a dark state; obtaining a display zone comprising both pixels in the bright state and pixels in the dark state based on the state of each pixel in the display panel, and using the obtained display zone as a destination zone, wherein the destination zone comprises both pixels in the bright state and pixels in the dark state; obtaining a halo region based on the state of the pixels in the destination zone, wherein the halo region comprises pixels in the dark state in the destination zone; generating a first control signal based on the halo region; and controlling based on the first control signal a backlight zone to be adjusted, wherein the backlight zone adjacent to a destination backlight zone is determined as the backlight zone to be adjusted, and wherein the destination backlight zone and the destination zone correspond to each other. By obtaining a halo region, controlling the backlight device based on the halo region and compensating for the size of the area of the halo region, the technical solution provided in this disclosure realizes a constant halo area, thereby preventing the halo from flickering with a constantly changing size and achieving a better display effect.

In one embodiment, the method for controlling the liquid crystal display device provided in the embodiments of this disclosure may further comprise a step of generating a second control signal based on the halo region.

The step can be concurrent with step 400, or preceded by step 400.

Furthermore, the method for controlling the liquid crystal display device provided in the embodiments of this disclosure may further comprise a step of controlling based on the second control signal a display zone corresponding to the backlight zone to be adjusted.

The step can be concurrent with step 500, or preceded by step 500.

In one embodiment, controlling based on the second control signal a display zone corresponding to the backlight zone to be adjusted may comprise controlling the pixels in the display zone corresponding to the backlight zone to be adjusted to be switched on or off. In one embodiment, more pixels in the display zone close to the destination zone are switched on to compensate for the area of the halo. More pixels in the display zone remote from the destination zone are switched off to exclude the halo. According to this disclosure, by controlling the display panel and the backlight device simultaneously, the area and the brightness of the halo region can remain constant.

In one embodiment, prior to step 100, the method for controlling the liquid crystal display device provided in the embodiments of this disclosure may further comprise: obtaining and storing inputted image data.

In one embodiment, the inputted image data are stored in the liquid crystal display device.

Figure 4:
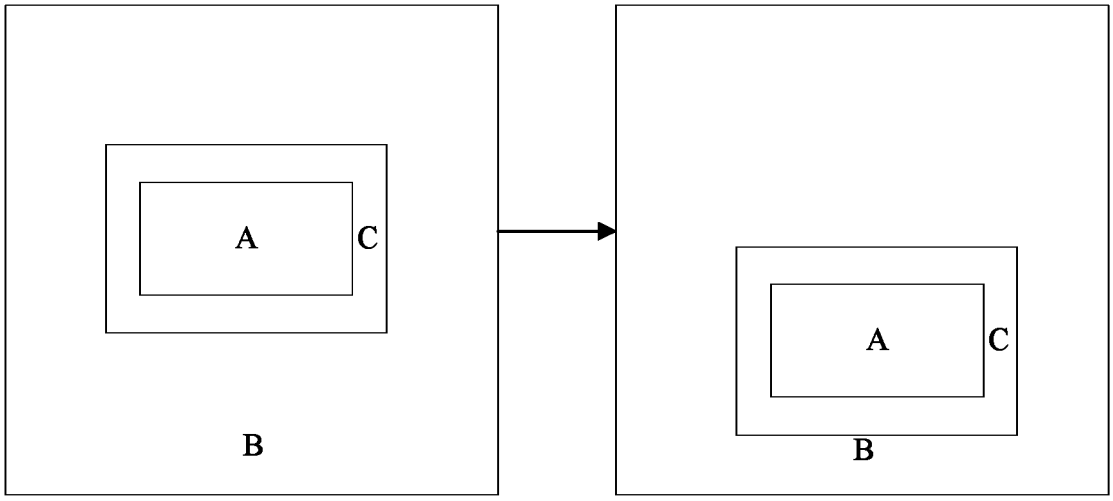
FIG. 4 is a schematic view showing halo changes before and after movement of the display content of the liquid crystal display device provided in an embodiment of this disclosure.

FIG. 4 is a schematic view showing halo changes before and after movement of the display content of the liquid crystal display device provided in an embodiment of this disclosure. As shown in FIG. 4, the halo area does not change before and after movement of the display content of the liquid crystal display device provided in the embodiment of this disclosure. No matter where the display content of the liquid crystal display device moves, the halo area will not change, which prevents the halo from flickering with a constantly changing size and achieves a better display effect.

Figure 5:
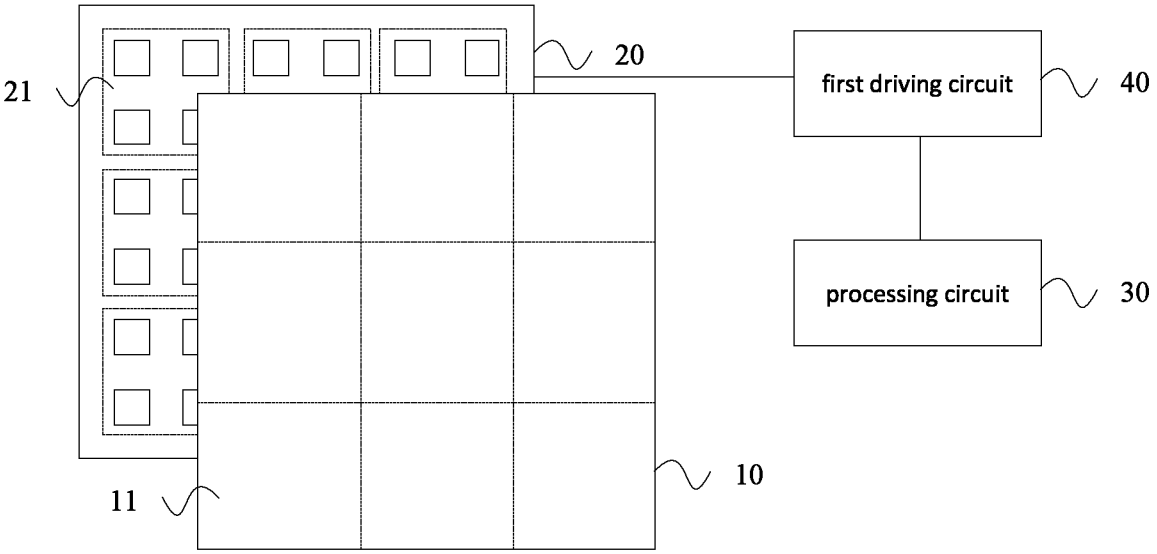
FIG. 5 is a schematic structure view of a liquid crystal display device provided in an embodiment of this disclosure.

Based on the inventive concept of the above embodiments, an embodiment of this disclosure provides a liquid crystal display device. FIG. 5 is a schematic structure view of a liquid crystal display device provided in an embodiment of this disclosure. As shown in FIG. 5, the liquid crystal display device provided in the embodiment of this disclosure may comprise a display panel 10 and a backlight device 20. The backlight device comprises at least one backlight zone 21. The display panel comprises at least one display zone 11. The backlight zone 21 and the display zone 11 correspond to each other. The liquid crystal display device may further comprise a processing circuit 30 and a first driving circuit 40.

In this embodiment, the processing circuit 30 is configured to: obtain a state of each pixel in the display panel based on inputted image data, the state of the pixel comprising a bright state or a dark state; obtain a display zone comprising both pixels in the bright state and pixels in the dark state based on the state of each pixel in the display panel, and use the obtained display zone as a destination zone; obtain a halo region based on the state of the pixels in the destination zone, wherein the halo region comprises pixels in the dark state in the destination zone; and generate a first control signal based on the halo region. The first driving circuit 40 is connected with the processing circuit 30 and the backlight device 20 and configured to control based on the first control signal a backlight zone to be adjusted, wherein the backlight zone adjacent to a destination backlight zone is determined as the backlight zone to be adjusted, and wherein the destination backlight zone and the destination zone correspond to each other.

In this embodiment, the liquid crystal display device provided in the embodiments of this disclosure is used for implementing the method for controlling the liquid crystal display device as mentioned above. The backlight device is used for transmitting via the display panel light for image display, and it comprises several light emitting elements, wherein the light emitting elements are light emitting diodes (LEDs), and at least one light emitting diode (LED) is arranged in an array, and each backlight zone comprises at least one light emitting diode (LED) arranged in an array. It should be noted that the number of zones divided in the backlight device and the display panel specifically depends on the arrangement of the liquid crystal display device, which will not be limited in the embodiments of this disclosure in any way.

In one embodiment, the inputted image data is RGB image data.

In this embodiment, the processing circuit 30 may be implemented by a processor executing logic operation, e.g., a device having a data processing ability and/or a program executing ability such as a Central Processing Unit (CPU), a Field Programmable Logic Array (FPGA), a Digital Signal Processor (DSP), a Microcontroller (MCU) and an Application Specific Integrated Circuit (ASIC).

In one embodiment, the processing circuit 30 may be configured to: obtain a brightness value of each pixel in the display panel based on inputted image data; and determine a state of each pixel based on the brightness value of each pixel and a threshold brightness, and determine that the pixel is in the bright state when the brightness value of the pixel is greater than or equal to the threshold brightness; and determine that the pixel is in the dark state when the brightness value of the pixel is smaller than the threshold brightness. It should be noted that the threshold brightness is selected based on specific situations, which will not be limited in the embodiments of this disclosure in any way.

In one embodiment, the processing circuit 30 may be configured to: obtain a halo region based on the pixels in the dark state in the destination zone; and determine whether an area of the halo region is equal to a threshold area, and generate a first control signal when the area of the halo region is not equal to the threshold area.

In one embodiment, the processing circuit 30 may be configured to: obtain based on the state of each pixel in the display panel a display zone in which the pixels are all in the dark state; determine whether a display zone adjacent to the display zone comprises the destination zone; if the display zone adjacent to the display zone comprises the destination zone, determine that a backlight zone corresponding to the display zone in which the pixels are all in the dark state is the backlight zone to be adjusted; if the display zone adjacent to the display zone does not comprise the destination zone, determine that a backlight zone corresponding to the display zone in which the pixels are all in the dark state is not the backlight zone to be adjusted.

In one embodiment, the processing circuit 30 may be configured to: obtain based on the state of each pixel in the display panel a display zone in which the pixels are all in the bright state; and determine that a backlight zone corresponding to the display zone is not the backlight zone to be adjusted.

It should be noted that the number of the destination zones is not just one, and it specifically depends on the inputted image data, and the number of the destination zones will not be specifically limited in the embodiments of this disclosure.

It should be noted that the threshold area depends on specific situations, which will not be limited in the embodiments of this disclosure in any way.

Figure 6:
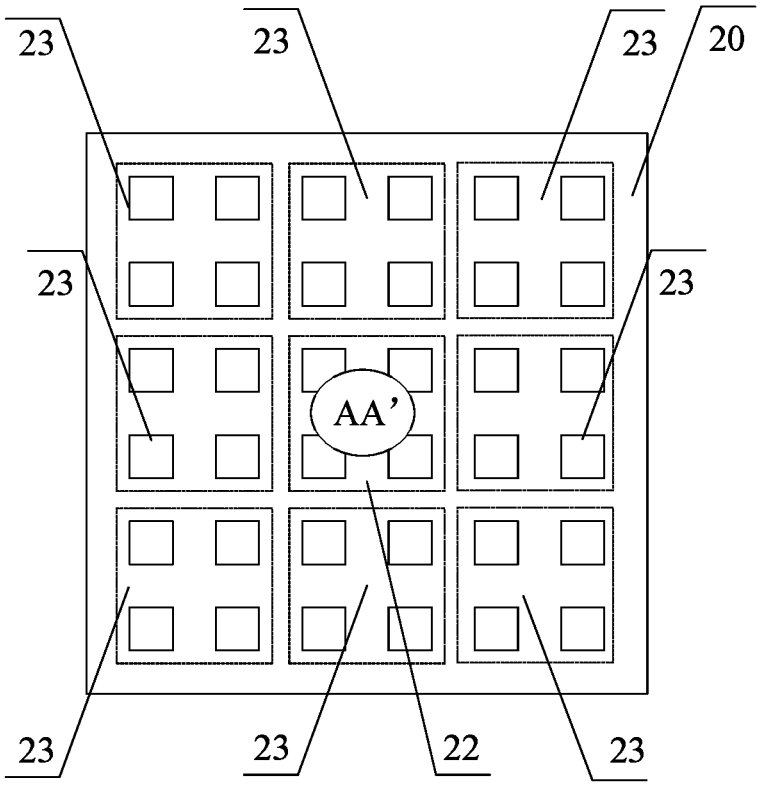
FIG. 6 is a top view of a backlight device provided in an embodiment of this disclosure.
Figure 7:
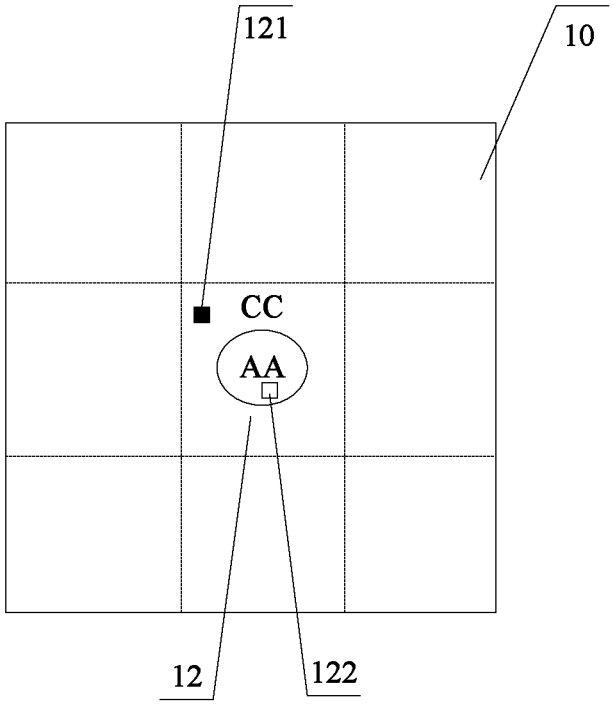
FIG. 7 is a top view of a display panel provided in an embodiment of this disclosure.
Figure 8:
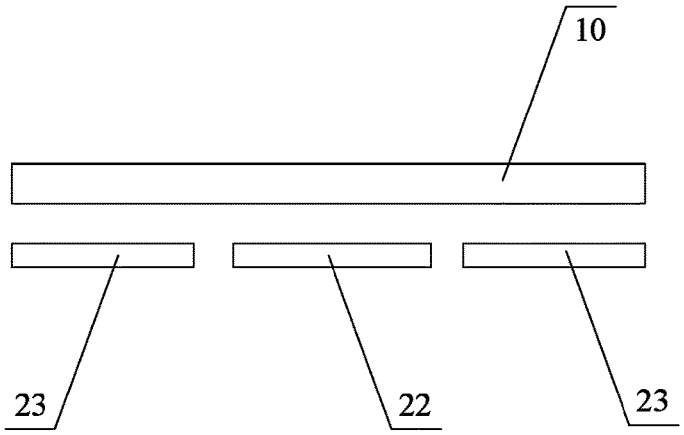
FIG. 8 is a side view of a liquid crystal display device provided in an embodiment of this disclosure.

FIG. 6 is a top view of a backlight device provided in an embodiment of this disclosure. FIG. 7 is a top view of a display panel provided in an embodiment of this disclosure. FIG. 8 is a side view of a liquid crystal display device provided in an embodiment of this disclosure. As shown in FIGS. 6-8, region AA is content displayed by the display panel 10. Region AA' is an orthogonal projection region of region AA on the backlight device 20. The display zone in which region AA is located is a destination zone 12. The destination zone 12 comprises both pixels 121 in the dark state and pixels 122 in the bright state. The backlight zone corresponding to the destination zone 12 is namely a destination backlight zone 22. As shown in FIG. 6, the backlight zone adjacent to the destination backlight zone 22 is for example a backlight zone 23 to be adjusted. The backlight zone 23 to be adjusted is controlled based on the first control signal in an embodiment of this disclosure. It should be noted that the embodiment of this disclosure illustrates an example in which the display panel and the backlight device comprise 9 zones and the display content is distributed in one and the same display zone. According to this disclosure, the display panel and the backlight device in the embodiments of this disclosure may comprise a plurality of zones and the display content may be distributed in a plurality of display zones, which will not be limited in the embodiments of this disclosure.

The liquid crystal display device provided in the embodiments of this disclosure comprises a display panel and a backlight device. The backlight device comprises at least one backlight zone. The display panel comprises at least one display zone. The backlight zone and the display zone correspond to each other. The liquid crystal display device provided in the embodiments of this disclosure further comprises a processing circuit and a first driving circuit. The processing circuit is configured to: obtain a state of each pixel in the display panel based on inputted image data, the state of the pixel comprising a bright state or a dark state; obtain a display zone comprising both pixels in the bright state and pixels in the dark state based on the state of each pixel in the display panel, and use the obtained display zone as a destination zone; obtain a halo region based on the state of the pixels in the destination zone, wherein the halo region comprises pixels in the dark state in the destination zone; and generate a first control signal based on the halo region. The first driving circuit is connected with the processing circuit and the backlight device and configured to control based on the first control signal a backlight zone to be adjusted. The backlight zone adjacent to a destination backlight zone is determined as the backlight zone to be adjusted, wherein the destination backlight zone and the destination zone correspond to each other. By obtaining a halo region, controlling the backlight device based on the halo region and compensating for the size of the area of the halo region, the technical solution provided in this disclosure realizes a constant halo area, thereby preventing the halo from flickering with a constantly changing size and achieving a better display effect.

Figure 9:
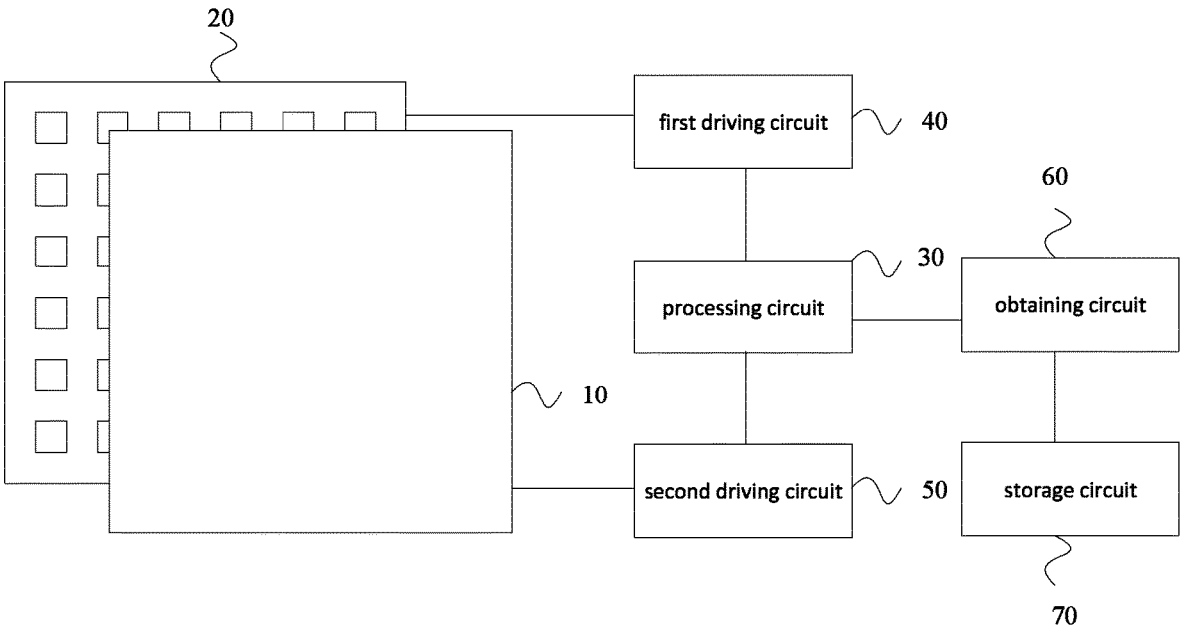
FIG. 9 is a schematic structure view of a liquid crystal display device provided in another embodiment of this disclosure.

FIG. 9 is a schematic structure view of a liquid crystal display device provided in another embodiment of this disclosure. As shown in FIG. 9, apart from all components in the liquid crystal display device shown in FIG. 5, the liquid crystal display device provided in the embodiment of this disclosure further comprises a second driving circuit 50.

The second driving circuit 50 is connected with the processing circuit 30 and the display panel 10.

In this embodiment, the processing circuit 30 provided in the embodiments of this disclosure is further configured to generate a second control signal based on the halo region. The second driving circuit 50 is configured to control based on the second control signal a display zone corresponding to the backlight zone to be adjusted.

In one embodiment, controlling based on the second control signal a display zone corresponding to the backlight zone to be adjusted may comprise controlling the pixels in the display zone corresponding to the backlight zone to be adjusted to be switched on or off. In one embodiment, more pixels in the display zone close to the destination zone are switched on to compensate for the area of the halo. More pixels in the display zone remote from the destination zone are switched off to exclude the halo. According to this disclosure, by controlling the display panel and the backlight device simultaneously, the area and the brightness of the halo region can remain constant.

In one embodiment, as shown in FIG. 9, the liquid crystal display device provided in the embodiment of this disclosure may further comprise: an obtaining circuit 60 and a storage circuit 70.

In this embodiment, the obtaining circuit 60 is connected with the processing circuit 30 and configured to obtain inputted image data. The storage circuit 70 is connected with the obtaining circuit 60 and configured to store the obtained inputted image data.

Besides, "connections" mentioned in the embodiments of this disclosure are all communicative connections. Specifically, the communicative connection comprises connection via wireless network, wired network, and/or any combinations of wireless network and wired network. The network may comprise local area network, Internet, telecommunication network, internet of things based on the Internet and/or telecommunication network, and/or any combinations of the above networks, etc. The wired network may transmit information, for example, by using a wire, a twisted pair cable, a coaxial cable, or an optical fiber transmission, and the wireless network may use, for example, a WWAN mobile communication network, Bluetooth, Zigbee, or WiFi.

Figure 10:
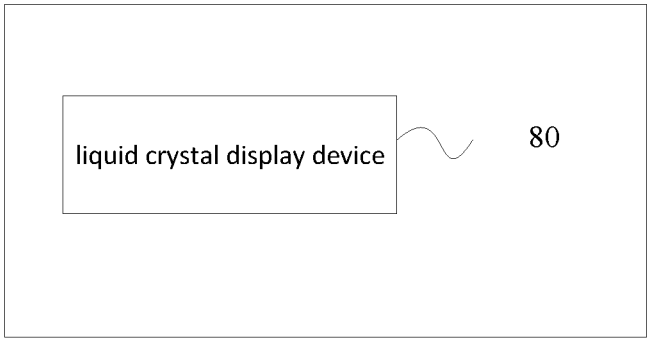
FIG. 10 is a schematic structure view of a head-mounted display device provided in an embodiment of this disclosure.

FIG. 10 is a schematic structure view of a head-mounted display device provided in an embodiment of this disclosure. The head-mounted display device may comprise a liquid crystal display device 80. The liquid crystal display device 80 can be a liquid crystal display device provided according to the embodiments of this disclosure. The implementation principle and the implementation effects are similar, which will not be repeated herein for simplicity.

Based on the inventive concept of the above embodiments, an embodiment of this disclosure further provides a computer-readable storage medium that stores a computer program capable of running on a processor, which when running on the processor, executes steps of the method for controlling the liquid crystal display device provided in the embodiments of this disclosure.

One having ordinary skills in the art can understand that functional circuits/units in all or some steps, systems and devices in the method disclosed above may be implemented as software, firmware, hardware and a suitable combination thereof. In the implementation of the hardware, the division of the functional circuits/units mentioned in the above description does not necessarily correspond to the division of the physical components; for example, a physical component may have a plurality of functions, or a function or step may be executed cooperatively by several physical components. Some or all components may be implemented as software executed by a processor, e.g., a digital signal processor or a micro-processor, or as hardware, or as an integrated circuit, e.g., a dedicated integrated circuit. Such software may be distributed on a computer-readable medium, and the computer-readable medium may comprise a computer storage medium (or a non-transitory medium) and a communication medium (or a transitory medium). As well known by one having ordinary skills in the art, the term of "computer storage medium" comprises volatile and non-volatile, removable and non-removable media implemented in any methods or technologies for storing information, such as computer-readable instructions, data structures, program circuits, or other data. Computer storage media comprise but are not limited to RAM, ROM, EEPROM, flash or other memory technology, CD-ROM, digital versatile disc (DVD) or other optical disc storage, magnetic cassette, magnetic tape, disk storage or other magnetic storage device, or any other medium that can be used for storing desired information and accessible by a computer. Besides, it is well known for one having ordinary skills in the art that, communication media usually comprise computer-readable instructions, data structures, program circuits or other data in modulated data signals such as carriers or other transmission mechanisms, and can comprise any information delivery media.

The drawings of the embodiments of this disclosure only relate to structures involved in the embodiments of this disclosure, and for the other structures, general designs can be referred to.

The embodiments of this disclosure, i.e., the features in the embodiments can be combined with each other to obtain new embodiments under the circumstances that there is no conflict.

Although the implementations of this disclosure are disclosed above, the contents thereof only relate to implementations adopted for understanding this disclosure instead of limiting this disclosure. Any skilled person in the art of this disclosure can make any modification and variation in terms of the form and the detail of the implementation without deviating from the spirits and scopes disclosed in this disclosure, but the patent protection scope of this disclosure should still be subject to the scope defined in the appended claims.

The invention claimed is:

1. A method for controlling a liquid crystal display device, the liquid crystal display device comprising a display panel and a backlight device, the backlight device comprising at least one backlight zone, the display panel comprising at least one display zone, the backlight zone and the display zone corresponding to each other, the method comprising:

obtaining a state of each pixel in the display panel based on inputted image data, the state of the pixel comprising a bright state or a dark state, wherein obtaining a state of each pixel in the display panel based on inputted image data comprises: obtaining a brightness value of each pixel in the display panel based on inputted image data; and determining a state of each pixel based on the brightness value of each pixel and a threshold brightness, and determining that the pixel is in the bright state when the brightness value of the pixel is greater than or equal to the threshold brightness; and determining that the pixel is in the dark state when the brightness value of the pixel is smaller than the threshold brightness;

obtaining a display zone comprising both pixels in the bright state and pixels in the dark state based on the state of each pixel in the display panel, and using the obtained display zone as a destination zone;

obtaining a halo region based on the state of the pixels in the destination zone, wherein the halo region is a region comprising pixels in the dark state in the destination zone;

generating a first control signal based on the halo region; and controlling based on the first control signal a backlight zone to be adjusted, wherein the backlight zone adjacent to a destination backlight zone is determined as the backlight zone to be adjusted, and the destination backlight zone and the destination zone correspond to each other.

2. The method according to claim 1, further comprising:

obtaining based on the state of each pixel in the display panel a display zone in which the pixels are all in the dark state;

determining whether a display zone adjacent to the display zone comprises the destination zone;

if the display zone adjacent to the display zone comprises the destination zone, determining that a backlight zone corresponding to the display zone in which the pixels are all in the dark state is the backlight zone to be adjusted;

if the display zone adjacent to the display zone does not comprise the destination zone, determining that a backlight zone corresponding to the display zone in which the pixels are all in the dark state is not the backlight zone to be adjusted.

3. The method according to claim 1, further comprising:

obtaining based on the state of each pixel in the display panel a display zone in which the pixels are all in the bright state; and determining that a backlight zone corresponding to the display zone is not the backlight zone to be adjusted.

4. The method according to claim 1, further comprising:

generating a second control signal based on the halo region; and controlling based on the second control signal a display zone corresponding to the backlight zone to be adjusted.

5. The method according to claim 4, wherein controlling based on the second control signal a display zone corresponding to the backlight zone to be adjusted comprises:

controlling the pixels in the display zone corresponding to the backlight zone to be adjusted to be switched on or off.

6. The method according to claim 5, wherein controlling the pixels in the display zone corresponding to the backlight zone to be adjusted to be switched on or off comprises:

switching on more pixels in the display zone close to the destination zone; and switching off more pixels in the display zone remote from the destination zone.

7. The method according to claim 1, wherein generating a first control signal based on the halo region comprises:

determining whether an area of the halo region is equal to a threshold area, and generating a first control signal when the area of the halo region is not equal to the threshold area.

8. The method according to claim 1, wherein prior to obtaining a state of each pixel in the display panel based on inputted image data, the method further comprises:

obtaining and storing inputted image data.

9. A liquid crystal display device, comprising:

a display panel comprising at least one display zone;

a backlight device comprising at least one backlight zone, wherein the backlight zone and the display zone correspond to each other;

a processing circuit configured to obtain a state of each pixel in the display panel based on inputted image data, the state of the pixel comprising a bright state or a dark state, obtaining a display zone comprising both pixels in the bright state and pixels in the dark state based on the state of each pixel in the display panel, using the obtained display zone as a destination zone, obtaining a halo region based on the state of the pixels in the destination zone, and generating a first control signal based on the halo region, wherein the halo region comprises pixels in the dark state in the destination zone; and a first driving circuit connected with the processing circuit and the backlight device and configured to control based on the first control signal a backlight zone to be adjusted, wherein the backlight zone adjacent to a destination backlight zone is determined as the backlight zone to be adjusted, and the destination backlight zone and the destination zone correspond to each other, wherein the processing circuit is further configured to:

obtain a brightness value of each pixel in the display panel based on inputted image data; and determine a state of each pixel based on the brightness value of each pixel and a threshold brightness, and determine that the pixel is in the bright state when the brightness value of the pixel is greater than or equal to the threshold brightness; and determine that the pixel is in the dark state when the brightness value of the pixel is smaller than the threshold brightness.

10. The liquid crystal display device according to claim 9, wherein the processing circuit is further configured to: obtain based on the state of each pixel in the display panel a display zone in which the pixels are all in the dark state; determining whether a display zone adjacent to the display zone comprises the destination zone; if the display zone adjacent to the display zone comprises the destination zone, determining that a backlight zone corresponding to the display zone in which the pixels are all in the dark state is the backlight zone to be adjusted; if the display zone adjacent to the display zone does not comprise the destination zone, determining that a backlight zone corresponding to the display zone in which the pixels are all in the dark state is not the backlight zone to be adjusted.

11. The liquid crystal display device according to claim 9, wherein the processing circuit is further configured to: obtain based on the state of each pixel in the display panel a display zone in which the pixels are all in the bright state; and determining that a backlight zone corresponding to the display zone is not the backlight zone to be adjusted.

12. The liquid crystal display device according to claim 9, wherein the processing circuit is further configured to: generate a second control signal based on the halo region; and wherein the device further comprises: a second driving circuit connected with the processing circuit and the display panel and configured to control based on the second control signal a display zone corresponding to the backlight zone to be adjusted.

13. The liquid crystal display device according to claim 9, wherein the processing circuit is further configured to:

obtain the halo region based on the pixels in the dark state in the destination zone; and determine whether an area of the halo region is equal to a threshold area, and generate the first control signal when the area of the halo region is not equal to the threshold area.

14. The liquid crystal display device according to claim 9, further comprising:

an obtaining circuit connected with the processing circuit and configured to obtain inputted image data; and a storage circuit connected with the obtaining circuit and configured to store the obtained inputted image data.

15. A head-mounted display device comprising the liquid crystal display device according to claim 9.

16. A computer-readable storage medium that stores a computer program capable of running on a processor, which when running on the processor, executes steps of the method for controlling the liquid crystal display device according to claim 1.

* * * * *